US011825269B2

(12) United States Patent
Guo et al.

(10) Patent No.: US 11,825,269 B2
(45) **Date of Patent: *Nov. 21, 2023**

(54) FEEDBACK ELIMINATION IN A HEARING AID

(71) Applicant: Oticon A/S, Smørum (DK)

(72) Inventors: Meng Guo, Smørum (DK); Bernhard Kuenzle, Düdingen (CH); Anders Meng, Smørum (DK); Martin Kuriger, Fribourg (CH); Mojtaba Farmani, Smørum (DK); Mikkel Grønbech, Smørum (DK); Sudershan Yalgalwadi Sreepadarao, Smørum (DK); Kim Tilgaard Petersen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/704,828

(22) Filed: Mar. 25, 2022

(65) Prior Publication Data

US 2022/0312129 A1 Sep. 29, 2022

(30) Foreign Application Priority Data

Mar. 26, 2021 (EP) ..... 21165219

(51) Int. Cl.
*H04R 25/00* (2006.01)

(52) U.S. Cl.
CPC ..... *H04R 25/453* (2013.01); *H04R 25/505* (2013.01)

(58) Field of Classification Search
CPC ..... H04R 25/45; H04R 25/453; H04R 25/505
See application file for complete search history.

(56) References Cited

U.S. PATENT DOCUMENTS

| | | | | |
|---|---|---|---|---|
| 10,687,152 | B2 * | 6/2020 | Kuriger | H04R 25/43 |
| 2010/0183164 | A1 | 7/2010 | Elmedyb et al. | |
| 2019/0132686 | A1 | 5/2019 | Kuriger et al. | |
| 2022/0148558 | A1 * | 5/2022 | Scheller | G10K 11/17875 |

FOREIGN PATENT DOCUMENTS

EP 3 139 636 A1 3/2017

OTHER PUBLICATIONS

European Search Report, issued in EP Application No. 21165219.3 dated Oct. 1, 2021.

* cited by examiner

*Primary Examiner* — Suhan Ni
(74) *Attorney, Agent, or Firm* — Birch, Stewart, Kolasch & Birch, LLP

(57) ABSTRACT

A hearing aid includes an input unit, an output unit, a signal processing unit connected to the input unit and output unit, where the input unit, the signal processing unit and the output unit form part of a forward path of the hearing aid, where the signal processing unit is configured to apply a forward gain to the at least one electric input signal or a signal originating therefrom. The hearing aid further includes a feedback reduction unit configured to reduce risk of howl due to acoustic, electrical, and/or mechanical feedback of an external feedback path from the output unit to the input unit. The feedback reduction unit is configured to modulate the forward gain in time to provide that the forward gain exhibits an increased or unchanged forward gain in one or more first time periods and a reduced forward gain in one or more second time periods.

16 Claims, 5 Drawing Sheets

FEEDBACK ELIMINATION IN A HEARING AID

SUMMARY

The present application relates to a hearing aid configured to be worn by a hearing aid user at or in an ear of the hearing aid user or to be fully or partially implanted in the head at an ear of a hearing aid user.

The present application further relates to a method of operating a hearing aid.

A Hearing Aid:

The present disclosure relates to the well-known acoustic feedback problem in audio systems comprising a forward path for amplifying an input sound from the environment picked up by an acoustic input transducer and an output transducer for presenting an amplified version of the input signal as an output sound to the environment, e.g. to one or more users.

Acoustic feedback problems occur due to the fact that the output loudspeaker signal of a hearing aid system is partly returned to the input microphone via an acoustic coupling, e.g. through the air. The part of the loudspeaker signal returned to the microphone is then re-amplified by the system before it is re-presented at the loudspeaker, and again returned to the microphone, etc. As this cycle continues, the effect of acoustic feedback becomes audible as artefacts or even worse, howling, when the system becomes unstable. The problem appears typically when the microphone and the loudspeaker are placed closely together, as in hearing aids, and often causes significant performance degradation.

Unstable systems due to acoustic feedback tend to significantly contaminate the desired audio input signal with narrow band frequency components, which are often perceived as howl or whistle.

A variety of feedback cancellation methods have been described to increase the stability of audio processing systems in hearing aids. One of the state-of-the-art solutions for reducing the effects of acoustic feedback is a cancellation system using an adaptive filter. Indeed, the feedback path of a hearing aid system, may vary over time.

Adaptive feedback cancellation has the ability to track feedback path changes over time and is e.g. based on an adaptive filter to estimate the feedback path. The adaptive filter weights are calculated and updated over time by an adaptive algorithm and the timing of calculation and/or the transfer of updated filter coefficients may be influenced by various properties of the signal of the forward path.

EP3139636A1 discloses a hearing device comprising a feedback reduction unit for reducing a risk of howl due to acoustic or mechanical feedback of an external feedback path from the output transducer to the input transducer. The forward path and the external feedback path define a loop path exhibiting a roundtrip loop delay. The feedback reduction unit is configured to modulate the requested forward gain in time to provide that the resulting forward gain exhibits a first, increased gain $A_H$ in a first time period $T_H$ and a second, reduced gain $A_L$ in a second time period $T_L$, wherein at least one of the first gain $A_H$, the second gain $A_L$, the first time period $T_H$, and the second time period $T_L$ is/are determined according to a predetermined or adaptively determined criterion. This spectral-temporal modulation (STM) technique allows for a reduction or elimination of external feedback.

However, even though the STM pattern is very efficient to break acoustic feedback loop, and thereby makes it possible to remove feedback whistling sounds even before it becomes audible, the resulting STM processed sound may be audible to some users.

Therefore, even though the STM processed sound is much less disturbing for the hearing aid user than the feedback howling sound, there is a need to provide a solution that addresses this above-mentioned problem of the audible STM processed sound.

In an aspect of the present application, a hearing aid configured to be worn by a hearing aid user at or in an ear of the hearing aid user or to be fully or partially implanted in the head at an ear of a hearing aid user is provided.

The hearing aid may comprise an input unit.

The input unit may be configured to receive an input sound signal from an environment of a hearing aid user.

The input unit may be configured to provide at least one electric input signal representing said input sound signal.

The input unit may comprise an input transducer, e.g. a microphone, for converting an input sound to an electric input signal. The input unit may comprise a wireless receiver for receiving a wireless signal comprising or representing sound and for providing an electric input signal representing said sound. The wireless receiver may e.g. be configured to receive an electromagnetic signal in the radio frequency range (3 kHz to 300 GHz). The wireless receiver may e.g. be configured to receive an electromagnetic signal in a frequency range of light (e.g. infrared light 300 GHz to 430 THz, or visible light, e.g. 430 THz to 770 THz).

An analogue electric signal representing an acoustic signal may be converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. A number of audio samples may be arranged in a time frame. A time frame may comprise 64 or 128 audio data samples. Other frame lengths may be used depending on the practical application.

The hearing aid may comprise an analogue-to-digital (AD) converter to digitize an analogue input (e.g. from an input transducer, such as a microphone) with a predefined sampling rate, e.g. 20 kHz.

The hearing aid may comprise an output unit.

The output unit may be configured to provide at least one set of stimuli perceivable as sound (an acoustic signal) to the hearing aid user based on a processed version of said at least one electric input signal.

The output unit may comprise a number of electrodes of a cochlear implant (for a CI type hearing aid) or a vibrator of a bone conducting hearing aid.

The output unit may comprise an output transducer. The output transducer may comprise a receiver (loudspeaker) for providing the stimulus as an acoustic signal to the user (e.g. in an acoustic (air conduction based) hearing aid). The output transducer may comprise a vibrator for providing the stimulus as mechanical vibration of a skull bone to the user (e.g. in a bone-attached or bone-anchored hearing aid).

The hearing aid may comprise a digital-to-analogue (DA) converter to convert a digital signal to an analogue output signal, e.g. for being presented to a user via an output transducer.

The hearing aid may comprise a signal processing unit.

The signal processing unit may be connected to the said input unit and output unit.

The term connected to may refer to the signal processing unit being connected and/or coupled mechanically to said input unit and output unit. The term connected to may refer to that the signal processing unit being operationally connected and/or coupled to said input unit and output unit so that e.g. electrical signals may be transferred from one to the other.

The signal processor may be configured to enhance the input signals from the input unit and providing a processed output signal to the output unit.

The hearing aid (the signal processor of the hearing aid) may be adapted to provide a frequency dependent gain and/or a level dependent compression and/or a transposition (with or without frequency compression) of one or more frequency ranges to one or more other frequency ranges, e.g. to compensate for a hearing impairment of a user.

The input unit, the signal processing unit, and the output unit may be forming part of a forward path of the hearing aid.

The hearing aid may comprise the 'forward' (or 'signal') path for processing an audio signal between the input and an output of the hearing aid.

The signal processor (signal processing unit) may be located in the forward path. The signal processor may be adapted to provide a frequency dependent gain according to the hearing aid user's particular needs (e.g. hearing impairment).

The hearing aid may comprise an 'analysis' path comprising functional components for analyzing signals and/or controlling processing of the forward path. Some or all signal processing of the analysis path and/or the forward path may be conducted in the frequency domain, in which case the hearing aid comprises appropriate analysis and synthesis filter banks. Some or all signal processing of the analysis path and/or the forward path may be conducted in the time domain.

The signal processing unit may be configured to apply a forward gain to the at least one electric input signal or a signal originating therefrom.

The forward gain may be a frequency- and/or level-dependent forward gain.

The hearing aid may comprise an acoustic (and/or mechanical) feedback control (e.g. suppression) or echo-cancelling system. Adaptive feedback cancellation has the ability to track feedback path changes over time. It is typically based on a linear time invariant filter to estimate the feedback path, but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

The hearing aid may further comprise a feedback reduction unit.

The feedback reduction unit may be configured to reduce a risk of howl due to acoustic, electrical, and/or mechanical feedback of an external feedback path from the output unit to the input unit of said hearing aid.

The feedback reduction unit may be configured to modulate said forward gain in time to provide that the forward gain exhibits an increased or unchanged forward gain $A_H$ in one or more first time periods $T_H$ and a reduced forward gain $A_L$ in one or more second time periods $T_L$.

In other words, the feedback reduction unit may be configured to provide an STM resulting signal.

The terms 'the increased or unchanged forward gain $A_H$' and 'the reduced forward gain $A_L$' are intended to mean increased or unchanged, and reduced, respectively, relative to a requested gain (at a given point in time (in a time-domain representation) or at a given point in time and frequency (in a time-frequency representation)). The term 'a requested gain' is in the present context taken to mean the gain that is to be applied to the electric input signal to provide an intended amplification of the electric input signal (e.g. to compensate for a user's hearing impairment and/or to compensate for a noisy environment, etc.). In general, the feedback reduction unit may be configured to modulate the requested frequency dependent forward gain in time, to provide that the resulting forward gain is higher than the requested gain in some periods of time and lower than the requested gain in other periods of time.

Thereby, as the increased or unchanged forward gain $A_H$ and the reduced forward gain $A_L$ are intended to mean increased or unchanged, and reduced, respectively, relative to a requested gain, the feedback reduction unit is configured to conserve energy in the resulting signal of the feedback reduction unit compared to the signal before/received by the feedback reduction unit.

The hearing aid may comprise a filler signal unit.

The filler signal unit may be configured to generate a filler signal.

The filler signal unit may be configured to provide said filler signal to the resulting signal of the feedback reduction unit in said one or more second time periods $T_L$, corresponding to said reduced forward gain $A_L$.

Accordingly, the present disclosure has the advantage of making the STM processed signal less audible. This may be done by adding said filler signal to the gaps (i.e. with reduced forward gain) in the STM pattern. This gap-filler signal makes the modulated signal sound smoother and hence reduces the audibility of STM processed signal. Thereby, an improved hearing aid may be provided.

The feedback reduction unit may be located between the signal processing unit and the output unit.

Alternatively, or additionally, the feedback reduction unit may be located in the forward path between the input unit and the signal processing uni.

Alternatively, or additionally, the signal processing unit may comprise the feedback reduction unit, such that the feedback reduction unit forms part of the signal processing unit.

The hearing aid may comprise at least one combination unit configured to combine (e.g. by subtraction and/or summation) two of more input signals to one output signal.

The filler signal unit may be located in an analysis path of the hearing aid. The filler signal unit may be connected/coupled (e.g. operationally) to the feedback reduction unit of the hearing aid.

The filler signal unit may be connected/coupled (e.g. operationally) to the combination unit of the hearing aid.

The filler signal unit may be configured to receive a signal from said feedback reduction unit. For example, the filler signal unit may be configured to receive a resulting signal from the feedback reduction unit, where the resulting signal is a modulated forward gain signal.

The filler signal unit may be configured to provide a filler signal to the combination unit of the hearing aid. The combination unit is configured to combine said filler signal and the resulting signal from the feedback reduction unit.

One or more of said increased or unchanged forward gain $A_H$, reduced forward gain $A_L$, one or more first time periods $T_H$, and one or more second time periods $T_L$ may be based (e.g. may be determined) according to a predetermined criterion.

One or more of said increased or unchanged forward gain $A_H$, reduced forward gain $A_L$, one or more first time periods $T_H$, and one or more second time periods $T_L$ may be based (e.g. may be determined) according to an adaptively determined criterion.

The forward path and the external feedback path of the hearing aid may define a loop path exhibiting a roundtrip loop delay.

For example, the roundtrip loop delay may be around 10 ms, such as in the range between 2 ms and 10 ms. For example, the roundtrip loop delay may be 0 ms. The roundtrip loop delay may be relatively constant over time and may e.g. be determined in advance of operation of the hearing aid, or be dynamically determined during use.

The criterion (predetermined criterion) may comprise that said one or more first time periods $T_H$ and said one or more second time periods $T_L$ time period are based in dependence of said, possibly averaged, roundtrip loop delay of said forward path and external feedback path. Said criterion may comprise that said one or more first time periods $T_H$ or said one or more second time periods $T_L$ are based in dependence of said, possibly averaged, roundtrip loop delay of said forward path and external feedback path.

The hearing aid may be configured to provide that said increased gain $A_H$ and/or said reduced gain $A_L$ are only applied in frequency bands expected to be at risk of howl.

The frequency band or bands expected to be at risk of howl may e.g. be estimated or determined in advance of normal operation of the hearing aid, e.g. at a fitting session, where the hearing aid may be configured/adapted to a particular hearing aid user's needs (e.g. the hearing e.g. to compensate for a hearing impairment of the user). Alternatively, or additionally, frequency band or bands expected to be at risk of howl may e.g. be selected automatically online, e.g. determined by a feedback detector for estimating a current level of feedback in a given frequency band.

Consequently, the filler signal unit may generate said filler signal according to this specific frequency pattern and provide it to the resulting signal (e.g. of the feedback reduction unit) in the second time period $T_L$ corresponding to the reduced gain $A_L$.

The filler signal may be independent or dependent on the STM pattern.

In other words, the filler signal unit may be configured to generate a filler signal based on the modulated forward gain from the feedback reduction unit.

In other words, the filler signal unit may be configured to generate a filler signal independent from the modulated forward gain from the feedback reduction unit.

The filler signal unit may be configured to provide a filler signal of equal numerical value as the difference in forward gain between successively modulated increased or unchanged forward gain $A_H$ and reduced forward gain $A_L$.

Thereby, the filler signal may be considered to be added in an "open-loop" manner (i.e., the filler signal will not travel around the feedback loop forever.

The filler signal unit may be configured to provide a filler signal smaller than the difference in forward gain between successively modulated increased or unchanged forward gain $A_H$ and reduced forward gain $A_L$.

Thereby, the filler signal may have a negative loop gain (<0 dB), so that it will not build up to create feedback, and further may improve the adaptive estimation of the feedback path, as the added filler signal further decorrelates the signals for an adaptive estimation of feedback path.

The filler signal unit may be configured to adaptively adjusting (e.g. adaptively determining) the size of the filler signal in the plurality of second time period $T_L$ corresponding to the reduced gain $A_L$.

Generating a filler signal may comprise providing an additional electric input signal representing sound to said resulting signal of the feedback reduction unit.

The filler signal may be based on a noise signal.

The filler signal may be independent or dependent on the STM pattern.

The magnitude/size of the noise signal may be computed based on the reduced forward gain $A_L$ of the resulting signal from the feedback reduction unit.

The magnitude/size of the noise signal may be of equal numerical value as the difference in forward gain between successively modulated increased or unchanged forward gain $A_R$ and reduced forward gain $A_L$.

The filler signal may be based on a noise signal, e.g. random noise generated depending on the corresponding original signal in the time period $T_L$ corresponding to the lowered gain $A_L$.

The filler signal may be based on the input sound signal from the environment of a hearing aid user.

In other words, the filler signal unit may be configured to receive at least part of the input sound signal and/or of the at least one electric input signal representing said input sound signal, and be configured to apply said input sound signal and/or electric input signal (possibly enhanced) as filler signal.

The hearing aid (e.g. the signal processing unit and/or the filler signal unit) may be configured to determine whether the input sound signal comprises one or more speech signals and/or a noise signal.

In response to the hearing aid (e.g. the signal processing unit and/or the filler signal unit) determines that the input sound signal comprises one or more speech signals, the filler signal unit may be configured to reconstruct a synthesize speech signal, based on a speech signal model.

The filler signal unit may be configured to reconstruct a synthesize speech signal resembling the one or more speech signals.

The filler signal unit may be configured to provide a filler signal based on the reconstructed a synthesize speech signal.

Thereby, the filler signal unit may provide a filler signal, which sounds (resembles) more like the original speech signal and thereby is perceived less disturbing by the user.

In response to the hearing aid (e.g. the signal processing unit and/or the filler signal unit) determines that the input sound signal comprises a noise signal, the filler signal unit may be configured to create a filler signal based on the noise signal.

The filler signal unit may be configured to create filler signal with similar properties as the noise signal.

Similar properties may refer to similar spectral shaping and/or similar intensity level, etc. as the noise signal.

The filler signal unit may be configured to synthesize a filler signal based on the magnitude (e.g. the sound pressure level (SPL)) of the input sound signal.

The filler signal unit may be configured to synthesize a filler signal based on the magnitude of the input sound signal, but based on a random phase.

The filler signal unit may be configured to estimate the size of the filler signal, based on the resulting signal from the feedback reduction unit.

For example, the size of the filler signal may comprise a bandwidth of 1000 Hz or more. For example, the size of the filler signal may comprise a bandwidth in the range of 500-2500 Hz. For example, the size of the filler signal may comprise an amplitude of 5 dB, 10 dB, 20 dB, 50 dB, or 100 dB, or less than 100 dB.

The filler signal unit may be configured to estimate the duration of the filler signal, based on the resulting signal from the feedback reduction unit.

The duration of the filler signal may depend on how long the STM pattern has been applied.

For example, the duration of the filler signal may be 50 ms-500 ms (however depending on the underlying feedback reduction unit).

The filler signal unit may be configured to estimate the periodicity of the filler signal, based on the resulting signal from the feedback reduction unit.

For example, the periodicity of the filler signal may depend on the feedback loop delay (e.g. as 1/(loop delay).

The filler signal unit may be configured to estimate the size, duration and/or periodicity of the filler signal based on advanced signal processing.

Advanced signal processing may refer to temporal-spectral masking techniques to determine the power of the filler signal.

Advanced signal reconstruction techniques may be advantageous with the aim of making the filler signal resemble the original unprocessed signal to a high degree.

The filler signal unit may be configured to estimate the size, duration and/or periodicity of the filler signal based on a neural network.

The hearing aid may comprise the neural network, such as a deep neural network.

The training of the neural network may be carried out in a server, such as a cloud server.

Thereby, the training may be distributed to a server and the hearing aid may receive a trained version of the neural network for filler signal estimation.

The training of the neural network may be carried out at least partly in an external device, such as a mobile device. Thereby, the training may be distributed at least partly to an external device and the hearing aid may receive a trained version of the neural network for filler signal estimation.

As training a neural network may be computationally intensive, carrying out the training outside the hearing aid such as in a server or in an external device may reduce the power consumption of the hearing aid.

For example, the neural network may be trained prior to the hearing aid user takes the hearing aid into use, such as in the product development phase based on e.g. prototype feedback scenarios and a library of corresponding sound signals so that a good default version of the parameters (weights) of the neural network (and corresponding filler signals) are available after the time of initial training of the neural network. The parameters (weights) of the neural network may be updated/further trained at regular intervals, such as when handed in for service.

For example, a (deep) neural network may transform the input signal using N samples/coefficients into the same type of N output samples/coefficients. The neural network may be a traditional feed-forward DNN with no memory, or a Long Short-Term Memory (LSTM) or Convolutional Recurrent Neural Network (CRNN), which both contain memory and thus are able to learn from previous input samples.

Thereby, as the filler signal may be considered to be applied in an open loop manner, it has no or little impact on feedback elimination effect of the STM pattern.

The hearing aid may further comprise a feedback cancellation unit.

Thereby, a further improved feedback cancelling/reducing hearing aid is provided.

The hearing aid may further comprise an analysis filter bank.

The analysis filter bank may provide that the electric input signal is divided into a number of frequency bands (e.g. 4, 8, or 64 bands) as band split electric input signals.

The hearing aid may further comprise a synthesis filter bank.

The filler signal unit of the hearing aid may be configured to generate a band split filler signal.

The filler signal unit of the hearing aid may be configured to provide said filler signal to a resulting band split signal of the feedback reduction unit.

Thereby, the filler signal may be added to each of the relevant frequency bands.

In other words, the hearing aid, e.g. the input unit, and/or the antenna and transceiver circuitry may comprise a TF-conversion unit for providing a time-frequency representation of an input signal. The time-frequency representation may comprise an array or map of corresponding complex or real values of the signal in question in a particular time and frequency range. The TF conversion unit may comprise a filter bank for filtering a (time varying) input signal and providing a number of (time varying) output signals each comprising a distinct frequency range of the input signal. The TF conversion unit may comprise a Fourier transformation unit for converting a time variant input signal to a (time variant) signal in the (time-)frequency domain. The frequency range considered by the hearing aid from a minimum frequency $f_{min}$ to a maximum frequency $f_{max}$ may comprise a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. A signal of the forward and/or analysis path of the hearing aid may be split into a number NI of frequency bands (e.g. of uniform width), where NI is e.g. larger than 5, such as larger than 10, such as larger than 50, such as larger than 100, such as larger than 500, at least some of which are processed individually. The hearing aid may be adapted to process a signal of the forward and/or analysis path in a number NP of different frequency channels (NP≤NI). The frequency channels may be uniform or non-uniform in width (e.g. increasing in width with frequency), overlapping or non-overlapping.

The hearing aid may comprise a directional microphone system adapted to spatially filter sounds from the environment, and thereby enhance a target acoustic source among a multitude of acoustic sources in the local environment of the user wearing the hearing aid. The directional system may be adapted to detect (such as adaptively detect) from which direction a particular part of the microphone signal originates. This can be achieved in various different ways as e.g. described in the prior art. In hearing aids, a microphone array beamformer is often used for spatially attenuating background noise sources. Many beamformer variants can be found in literature. The minimum variance distortionless response (MVDR) beamformer is widely used in microphone array signal processing. Ideally, the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing aid may comprise antenna and transceiver circuitry allowing a wireless link to an entertainment device (e.g. a TV-set), a communication device (e.g. a telephone), a wireless microphone, or another hearing aid, etc. The hearing aid may thus be configured to wirelessly receive a direct electric input signal from another device. Likewise, the hearing aid may be configured to wirelessly transmit a direct electric output signal to another device. The direct electric input or output signal may represent or comprise an audio signal and/or a control signal and/or an information signal and/or information regarding the modulated forward gain and/or the generated filler signal.

In general, a wireless link established by antenna and transceiver circuitry of the hearing aid can be of any type. The wireless link may be a link based on near-field communication, e.g. an inductive link based on an inductive coupling between antenna coils of transmitter and receiver parts. The wireless link may be based on far-field, electromagnetic radiation. Preferably, frequencies used to establish a communication link between the hearing aid and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM—Industrial, Scientific and Medical, such standardized ranges being e.g. defined by the International Telecommunication Union, ITU). The wireless link may be based on a standardized or proprietary technology. The wireless link may be based on Bluetooth technology (e.g. Bluetooth Low-Energy technology).

The hearing aid may be or form part of a portable (i.e. configured to be wearable) device, e.g. a device comprising a local energy source, e.g. a battery, e.g. a rechargeable battery. The hearing aid may e.g. be a low weight, easily wearable, device, e.g. having a total weight less than 100 g, such as less than 20 g.

The hearing aid may be configured to operate in different modes, e.g. a normal mode and one or more specific modes, e.g. selectable by a user, or automatically selectable. A mode of operation may be optimized to a specific acoustic situation or environment. A mode of operation may include a low-power mode, where functionality of the hearing aid is reduced (e.g. to save power), e.g. to disable wireless communication, and/or to disable specific features of the hearing aid.

The hearing aid may comprise a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively, or additionally, one or more detectors may form part of an external/auxiliary device in communication (e.g. wirelessly) with the hearing aid. An external device may e.g. comprise another hearing aid, a remote control, and audio delivery device, a telephone (e.g. a smartphone), an external sensor, etc.

One or more of the number of detectors may operate on the full band signal (time domain). One or more of the number of detectors may operate on band split signals ((time-) frequency domain), e.g. in a limited number of frequency bands.

The number of detectors may comprise a level detector for estimating a current level of a signal of the forward path. The detector may be configured to decide whether the current level of a signal of the forward path is above or below a given (L-)threshold value. The level detector operates on the full band signal (time domain). The level detector operates on band split signals ((time-) frequency domain).

The hearing aid may comprise a classification unit configured to classify the current situation based on input signals from (at least some of) the detectors, and possibly other inputs as well.

In the present context 'a current situation' may be taken to be defined by one or more of a) the physical environment (e.g. including the current electromagnetic environment, e.g. the occurrence of electromagnetic signals (e.g. comprising audio and/or control signals) intended or not intended for reception by the hearing aid, or other properties of the current environment than acoustic)

b) the current acoustic situation (input level, feedback, etc.)

c) the current mode or state of the user (movement, temperature, cognitive load, etc.)

d) the current mode or state of the hearing aid (program selected, time elapsed since last user interaction, etc.) and/or of another device in communication with the hearing aid.

The hearing aid may comprise one or more motion detectors/sensors.

For example, the motion detectors may comprise an accelerometer.

Acoustic feedback problems may occur in many situations, due to changes in the acoustic feedback path. For example, situations with acoustic feedback problem may occur when a hearing aid user is yawning and chewing. Having feedback artefacts in hearing aids may be a difficult problem to resolve as the feedback may happen rapidly and constantly. Such an event (that causes a feedback path change) may be difficult to detect before it is too late from the hearing aid point of view.

One or more motion detectors in hearing aids may be used to identify such fast feedback provoking events, i.e., yawning and chewing. Further, the one or more motion detectors may be detecting head turning/nodding and more generic movements that may add to artefacts and/or loosening of the hearing aid. For example, when there is a head turning movement, which leads to a shorter distance from ear to shoulder, feedback may arise.

Based on the information regarding the feedback provoking events, the feedback control system in hearing aids may be adjusted to better handle the events.

Accordingly, the feedback reduction system of the hearing aid may be configured to modulate said forward gain in time in response to the one or more motion detectors detect feedback provoking events.

The feedback cancelling system of the hearing aid may be configured to cancel/reduce feedback in response to the one or more motion detectors detect feedback provoking events.

The hearing aid may be configured to sample the at least one electric input signal at 40 kHz without changing the sampling frequency.

The hearing aid may be configured to sample one electric input signal (e.g. as received by a microphone) with two A/D converters in parallel, where one may be delayed by half a sample. The two signals from the two A/D converters may then be transformed into the frequency domain. The high and low frequencies of the two signals may be calculated using a complex butterfly. Thereby, a decimation in time may be performed.

Based on the two signals, two options may be carried out:

The high frequency part may be processed in a separate (much simplified) signal path, and be converted back to time domain together with the low frequency part resulting in a true 40 kHz signal. Preferably, at the hearing aid may comprise a 2-way output transducer.

Frequency Lowering may be applied to shift the high frequency signals down to just below 10 kHz. The rest of the hearing aid processing may remain the same.

The hearing aid may further comprise other relevant functionality for the application in question, e.g. compression, noise reduction, etc.

The hearing aid may comprise a hearing instrument, e.g. a hearing instrument adapted for being located at the ear or fully or partially in the ear canal of a user, e.g. a headset, an earphone, an ear protection device or a combination thereof. The hearing assistance system may comprise a speakerphone (comprising a number of input transducers and a number of output transducers, e.g. for use in an audio conference situation), e.g. comprising a beamformer filtering unit, e.g. providing multiple beamforming capabilities.

Use:

In an aspect, use of a hearing aid as described above, in the 'detailed description of embodiments' and in the claims, is moreover provided. Use may be provided in a system comprising one or more hearing aids (e.g. hearing instruments), headsets, ear phones, active ear protection systems, etc., e.g. in handsfree telephone systems, teleconferencing systems (e.g. including a speakerphone), public address systems, karaoke systems, classroom amplification systems, etc.

Use may be provided in a system comprising audio distribution, e.g. a system comprising a microphone and a loudspeaker in sufficiently close proximity of each other to cause feedback from the loudspeaker to the microphone during operation by a user.

A Method:

In an aspect, a method of processing an electric input signal representing sound is provided.

The method may comprise receiving an input sound signal from an environment of a hearing aid user.

The method may comprise providing at least one electric input signal representing said input sound signal, by an input unit.

The method may comprise providing at least one set of stimuli perceivable as sound to the hearing aid user based on a processed version of said at least one electric input signal, by an output unit.

The method may comprise applying a forward gain to the at least one electric input signal or a signal originating therefrom, by a signal processing unit connected to the said input unit and output unit.

The input unit, the signal processing unit and the output unit may form part of a forward path of the hearing aid.

The method may comprise applying a forward gain to the at least one electric input signal or a signal originating therefrom, by the signal processing unit.

The method may comprise providing a processed version of said at least one electric input signal, by the signal processing unit.

The hearing aid may further comprise a feedback reduction unit for reducing a risk of howl due to acoustic, electrical, or mechanical feedback of an external feedback path from the output unit to the input unit of said hearing aid.

The method may comprise modulating said forward gain in time, to provide that the forward gain exhibits an increased or unchanged forward gain $A_H$ in one or more first time periods $T_H$ and a reduced forward gain $A_L$ in one or more second time periods $T_L$, by the feedback reduction unit.

The method may comprise generating a filler signal by a filler signal unit of the hearing aid.

The method may comprise providing said filler signal to the resulting signal of the feedback reduction unit in said one or more second time periods $T_L$, corresponding to said reduced forward gain $A_L$, by the filler signal unit of the hearing aid.

It is intended that some or all of the structural features of the hearing aid described above, in the 'detailed description of embodiments' or in the claims can be combined with embodiments of the method, when appropriately substituted by a corresponding process and vice versa. Embodiments of the method have the same advantages as the corresponding hearing aid.

A Computer Readable Medium or Data Carrier:

In an aspect, a tangible computer-readable medium (a data carrier) storing a computer program comprising program code means (instructions) for causing a data processing system (a computer) to perform (carry out) at least some (such as a majority or all) of the (steps of the) method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Other storage media include storage in DNA (e.g. in synthesized DNA strands). Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing aid as described above, in the 'detailed description of embodiments', and in the claims, AND an auxiliary device is moreover provided.

The hearing system may be adapted to establish a communication link between the hearing aid and the auxiliary device to provide that information (e.g. control and status signals, possibly audio signals) can be exchanged or forwarded from one to the other.

The auxiliary device may comprise a remote control, a smartphone, or other portable or wearable electronic device, such as a smartwatch or the like.

The auxiliary device may be constituted by or comprise a remote control for controlling functionality and operation of the hearing aid(s). The function of a remote control may be implemented in a smartphone, the smartphone possibly running an APP allowing to control the functionality of the audio processing device via the smartphone (the hearing aid(s) comprising an appropriate wireless interface to the smartphone, e.g. based on Bluetooth or some other standardized or proprietary scheme).

The auxiliary device may be constituted by or comprise an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid.

The auxiliary device may be constituted by or comprise another hearing aid. The hearing system may comprise two hearing aids adapted to implement a binaural hearing system, e.g. a binaural hearing aid system.

A hearing system may be provided. The hearing system may comprise left and right hearing aids according to above.

The left and right hearing aids may be configured to be worn in or at left and right ears, respectively, of said hearing aid user, and/or to be fully or partially implanted in the head at left and right ears, respectively, of the hearing aid user.

The left and right hearing aids may be configured to establish a wired or wireless connection between them allowing data, e.g. audio data, to be exchanged between them, optionally via an auxiliary device.

An APP:

In a further aspect, a non-transitory application, termed an APP, is furthermore provided by the present disclosure. The APP comprises executable instructions configured to be executed on an auxiliary device to implement a user interface for a hearing aid or a hearing system described above in the 'detailed description of embodiments', and in the claims. The APP may be configured to run on a cellular phone, e.g. a smartphone, or on another portable device allowing communication with said hearing aid or said hearing system.

Definitions:

In the present context, a hearing aid, e.g. a hearing instrument, refers to a device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing aid may comprise a single unit or several units communicating (e.g. acoustically, electrically or optically) with each other. The loudspeaker may be arranged in a housing together with other components of the hearing aid, or may be an external unit in itself (possibly in combination with a flexible guiding element, e.g. a dome-like element).

A hearing aid may be adapted to a particular user's needs, e.g. a hearing impairment. A configurable signal processing circuit of the hearing aid may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing aid via an interface to a programming device (fitting system), and used by a processing algorithm executed by the configurable signal processing circuit of the hearing aid.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Such auxiliary devices may include at least one of a remote control, a remote microphone, an audio gateway device, an entertainment device, e.g. a music player, a wireless communication device, e.g. a mobile phone (such as a smartphone) or a tablet or another device, e.g. comprising a graphical interface. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person. Hearing aids or hearing systems may e.g. form part of or interact with public-address systems, active ear protection systems, handsfree telephone systems, car audio systems, entertainment (e.g. TV, music playing or karaoke) systems, teleconferencing systems, classroom amplification systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

Figure 1A:
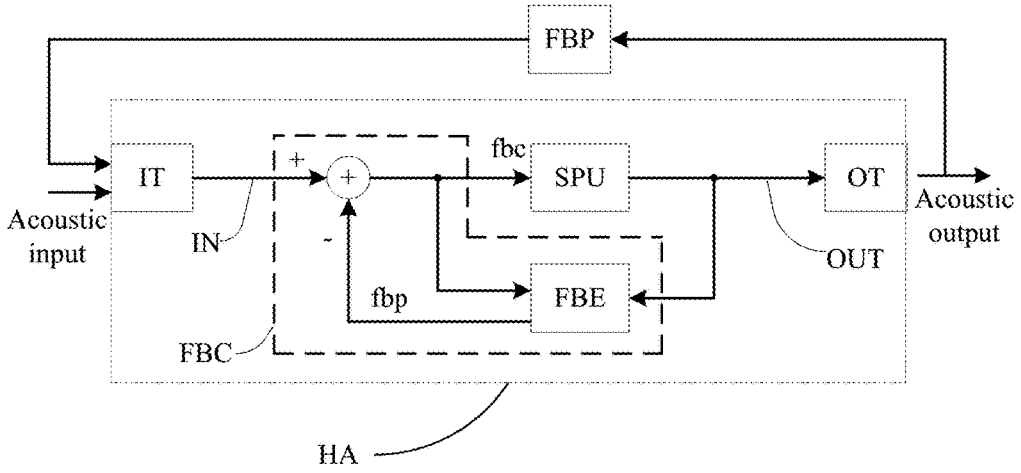
FIG. 1A shows an exemplary hearing aid comprising a feedback cancellation system according to prior art.

FIG. 1A shows an exemplary hearing aid comprising a feedback cancellation system according to prior art.

The hearing aid (HA) may be configured to be worn by a hearing aid user at or in an ear of the hearing aid user or to be fully or partially implanted in the head at an ear of a hearing aid user. The hearing aid (HA) may be configured to compensate for a hearing loss of the hearing aid user.

In FIG. 1A, the hearing aid is shown to comprise a forward path for processing at least one electric input signal representing an input sound signal from an environment of the hearing aid user.

The forward path may comprise an input unit, shown as an input transducer (IT) (e.g. microphones), for picking up sound ('Acoustic input') from the environment of the hearing aid (HA) and providing respective at least one electric input signal (IN). The forward path may further comprise a signal processing unit (SPU) for processing the at least one electric input signal (IN) or one or more signals originating therefrom and providing one or more processed signals (OUT) based thereon. The forward path may further comprise an output unit, shown as an output transducer (OT) (e.g. a loudspeaker or a vibrator) for generating stimuli perceivable by the user as sound ('Acoustic output') based on the one or more processed signals (OUT).

The hearing aid (HA) may further comprise a feedback cancellation unit (FBC) for feedback control (e.g. attenuation or removal), wherein said feedback cancellation unit (FBC) may comprise a feedback estimation unit (FBE) configured to estimate a current feedback path (FBP) from the output transducer (OT) to the input transducer (IT) and providing a feedback path estimate signal (fbp) indicative thereof.

The hearing aid (HA) may further comprise a combination unit (here a summation (subtraction) unit, '+') for combining the electric input signal (IN) or a signal derived therefrom and the feedback path estimate signal (fbp) estimated by said feedback cancellation unit (FBC) (here subtracting the feedback path estimate signal (fbp) from the electric input signal (IN)), to provide a resulting feedback corrected signal (fbc).

The feedback estimation unit (FBE) may estimate the current feedback path (FBP) based on the one or more processed signals (OUT) from the signal processing unit (SPU) and the resulting feedback corrected signal (fbc) from the combination unit ('+').

Figure 1B:
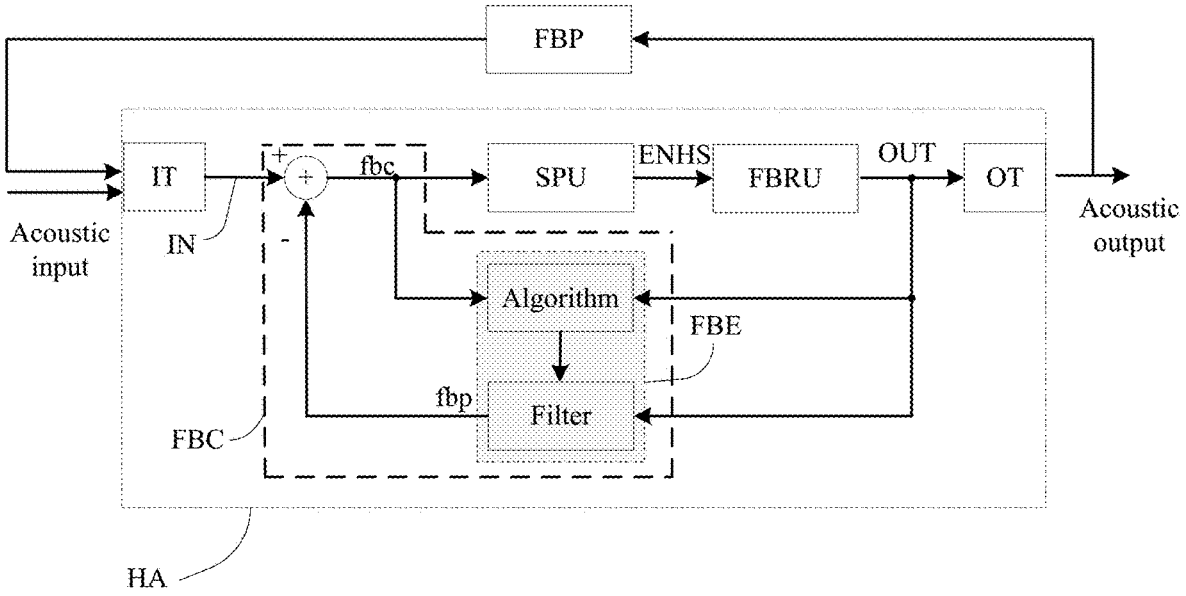
FIG. 1B shows an exemplary hearing aid comprising a feedback cancellation system according to prior art and, in particular, comprising an adaptive filter.

FIG. 1B shows an exemplary hearing aid comprising a feedback cancellation system according to prior art and, in particular, comprising an adaptive filter.

In FIG. 1B, it is shown that the hearing aid (HA) may comprise a feedback reduction unit (FBRU) in the forward path of the hearing aid. The forward path shown in FIG. 1B comprises the same functional units as shown in FIG. 1A, and additionally the feedback reduction unit (FBRU).

The feedback reduction unit (FBRU) is illustrated to be located between the signal processing unit (SPU) and the output transducer (OT). The feedback reduction unit (FBRU) may alternatively be located elsewhere in the forward path, e.g. between the input transducer (IT) (of the input unit) and the signal processing unit (SPU), or it may form part of the signal processing unit (SPU).

The input transducer (IT) may provide a digitized electric input signal (IN) representative of the Acoustic input. This signal is fed to the signal processing unit (SPU) providing an enhanced signal (ENHS) (after application of a requested (e.g. frequency and/or level dependent) forward gain to the electric input signal (IN)). The enhanced signal ENHS is fed to the feedback reduction unit (FBRU) providing a resulting signal OUT, which is fed to the output transducer (OT) (of the output unit) for conversion to an Acoustic output.

The feedback reduction unit (FBRU) may be configured to modulate the requested forward gain in time. Preferably, the requested forward gain applied to the signal processing unit (SPU) is modulated to provide that a resulting forward gain exhibits an increased or unchanged forward gain $A_H$ in one or more first time period $T_H$ and a reduced forward gain $A_L$ in one or more second time period $T_L$, (cf. e.g. FIG. 4A).

The hearing aid (HA) of FIG. 1B may additionally comprise a feedback cancellation unit (FBC) comprising a feedback estimation unit (FBE) for providing a feedback path estimate signal (fbp) (of the estimated current feedback path (FBP) from the output transducer to the input transducer) and a combination unit ('+'), (as also shown in FIG. 1A). The input signal to the adaptive filter (Algorithm and Filter units) of the FBE is preferably the resulting signal (OUT) of the feedback reduction unit (FBRU).

Figure 2:
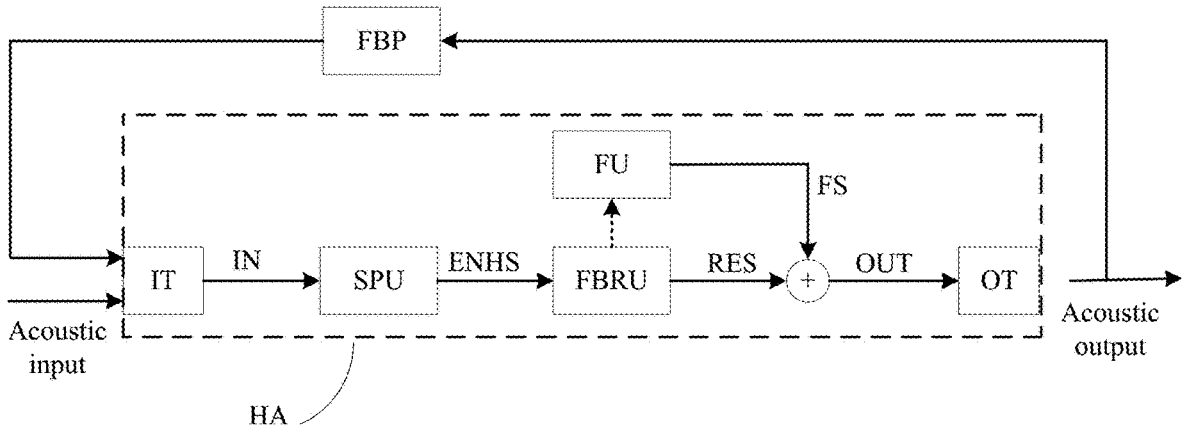
FIG. 2 shows an exemplary hearing aid comprising a feedback reduction unit and a filler signal unit.

FIG. 2 shows an exemplary hearing aid comprising a feedback reduction unit and a filler signal unit.

In FIG. 2, it is shown that the hearing aid (HA) may comprise a feedback reduction unit (FBRU) in the forward path. The feedback reduction unit (FBRU) may be configured to produce a spectral-temporal modulation (STM) on the enhanced signal (ENHS) from the signal processing unit (SPU) according to a specific modulated/alternating increased-reduced forward gain pattern and to provide a resulting signal (RES).

The hearing aid (HA) may additionally comprise a filler signal unit (FU) configured to generate said a filler signal (FS). The filler signal unit (FU) may be configured to provide said filler signal (FS) to the resulting signal (RES) (from the feedback reduction unit (FBRU)) by a combination unit ('+') in a second time period $T_L$, corresponding to a reduced resulting forward gain $A_L$. The filler signal unit (FU) may generate a filler signal (FS) that is independent or dependent on the STM pattern.

Figure 4A:
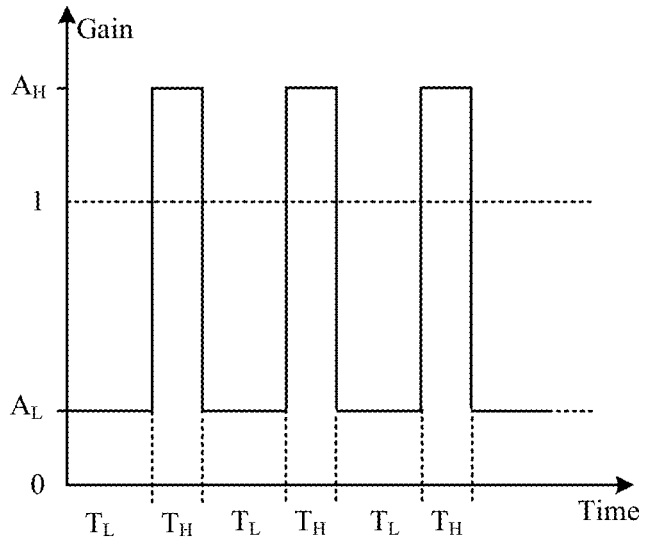
FIG. 4A shows an exemplary modulated forward gain pattern.

FIG. 4A shows an exemplary modulated forward gain pattern.

FIG. 4A shows an example of a repetitive time (Time) dependent forward gain (Gain) pattern that may be applied to a signal of the forward path by a feedback reduction unit of a hearing aid. The exemplary modulated gain pattern may comprise a rectangular pulse shaped pattern where a second time period $T_L$ may be larger than a first time period $T_H$.

The modulated gain shown in FIG. 4A (bold solid line) consists of repeated periods of increased (high) forward gain $A_H$ and reduced (low) forward gain $A_L$ with durations of TH and TL, respectively, relative to a predetermined required forward gain, equated to the gain value 1 (dotted line), as applied by a signal processing unit of a hearing aid.

Figure 3:
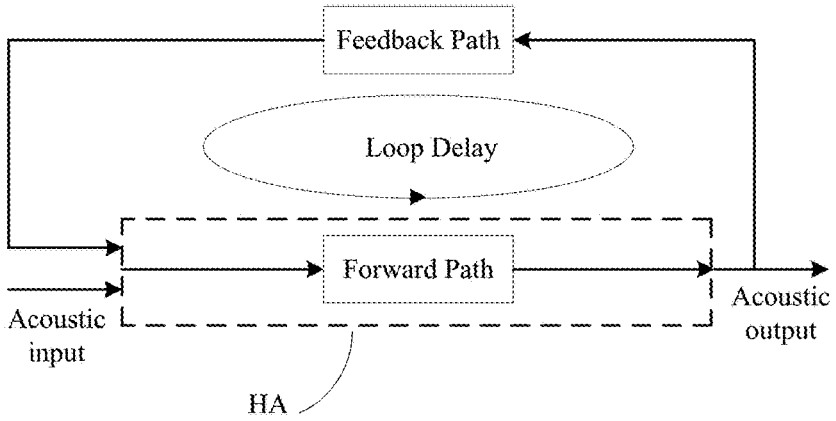
FIG. 3 shows an exemplary round-trip loop delay in the hearing aid.

The first and second time periods (TH and TL, respectively) may be determined in dependence of the round-trip loop delay (cf. e.g. FIG. 3 showing an exemplary round-trip loop delay in the hearing aid). The repeated periods of increased (high) forward gain $A_H$ and reduced (low) forward gain $A_L$ may be of similar size of vary/adaptively adjusted after each round-trip loop.

Additionally, or alternatively, the durations of $T_H$ and $T_L$ may be in a similar order of magnitude as (e.g. approximately equal to) the loop delay $T_{loop}$ (see FIG. 3) in the acoustic feedback system. $T_H$ and $T_L$ may be adjusted to obtain different performance. Both time periods may be close to the loop delay $T_{loop}$. As an example, when the loop delay $T_{loop}$=10 ms, the duration of $T_L$ may be chosen to be $T_L$=5 ms, 9 ms, 10 ms, 11 ms, . . . or 30 ms etc, and the duration of $T_H$ may be chosen to be $T_H$=30 ms, 11 ms, 10 ms, 9 ms, 5 ms etc. The first ($T_H$) and second time periods ($T_L$) may alternatively be equal ($T_H$=$T_L$). The forward gain pattern is shown as a rectangular pattern in FIG. 4A, but may alternatively take any other appropriate form, e.g. involving a smooth transition from decreased forward gain ($A_L$) to increased forward gain ($A_H$) and/or from increased forward gain ($A_H$) to decreased forward gain ($A_L$), or e.g. a gradual transition.

Figure 4B:
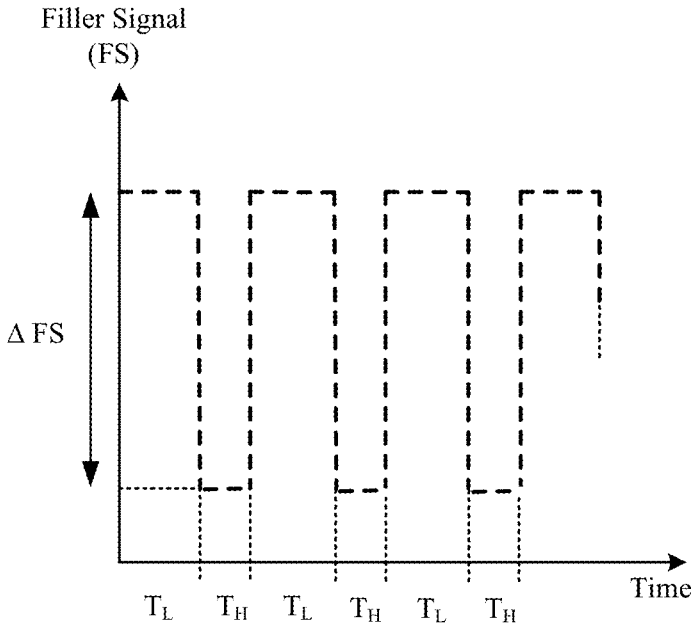
FIG. 4B shows an exemplary temporal filler signal pattern.

FIG. 4B shows an exemplary temporal filler signal pattern.

FIG. 4B shows schematically an example of a filler signal generated by the filler signal unit in dependence of the modulated forward gain pattern (STM pattern) as illustrated in FIG. 4A.

The filler signal may have an opposite behavior as of the modulated forward gain applied by the feedback reduction unit on the enhanced signal from the signal processing unit. In other words, when the filler signal is added to the resulting signal (by a combination unit), it may fill (partly or completely) the gaps produced by the (STM) modulation on the resulting signal of the feedback reduction unit and therefore allow for an output acoustic signal which sounds smoother in the ear of the hearing aid user.

The increased forward gain (AH) and decreased forward gain (AL) in the modulated forward gain pattern may be of around 1 and around 0, respectively. In this case, the filler signal may be considered to be added in an "open-loop" manner (i.e., the filler signal will not travel around the feedback loop "forever"). Alternatively, in case the increased forward gain (AH) and decreased forward gain (AL) are between 0 and 1, the filler signal may be added not-completely in an "open loop", but with a proper negative loop gain (<0 dB). Thereby, the filler signal will not build up to create feedback, and additionally it can actually improve the adaptive estimation of the feedback path, as the added filler signal further decorrelates the signals for the adaptive estimation of feedback path.

The filler signal unit may be configured to provide a filler signal of equal numerical size/value (AFS) as the difference in forward gain between successively modulated increased forward gain $A_H$ and reduced forward gain $A_L$. Alternatively, or additionally, the filler signal unit may be configured to provide a size/value (ΔFS) of the filler signal that is smaller than the difference in forward gain between successively modulated increased forward gain $A_H$ and reduced forward gain $A_L$.

The filler signal unit may be configured to adaptively adjusting (e.g. adaptively determining) the size/value (AFS) of the filler signal in the plurality of second time period $T_L$ corresponding to the reduced gain $A_L$.

The durations of the filler signal may correspond to the duration to the durations of the one or more second time periods $T_L$ of reduced forward gain $A_L$. For example, durations of the filler signal may be equal to the durations of the one or more second time periods $T_L$ of reduced forward gain $A_L$.

The durations of the filler signal may be in a similar order of magnitude as (e.g. approximately equal to) the loop delay $T_{loop}$ (see FIG. 3) in the acoustic feedback system. For example, when the loop delay $T_{loop}$=10 ms, the durations of the filler signal may be chosen to be 5 ms, 9 ms, 10 ms, 11 ms, . . . or 30 ms etc.

The filler signal is shown as a rectangular pattern in FIG. 4B, but may alternatively take any other appropriate form, e.g. involving a smooth transition from decreased filler signal to increased filler signal and/or from increased filler signal to decreased filler signal, or e.g. a gradual transition.

Figure 5:
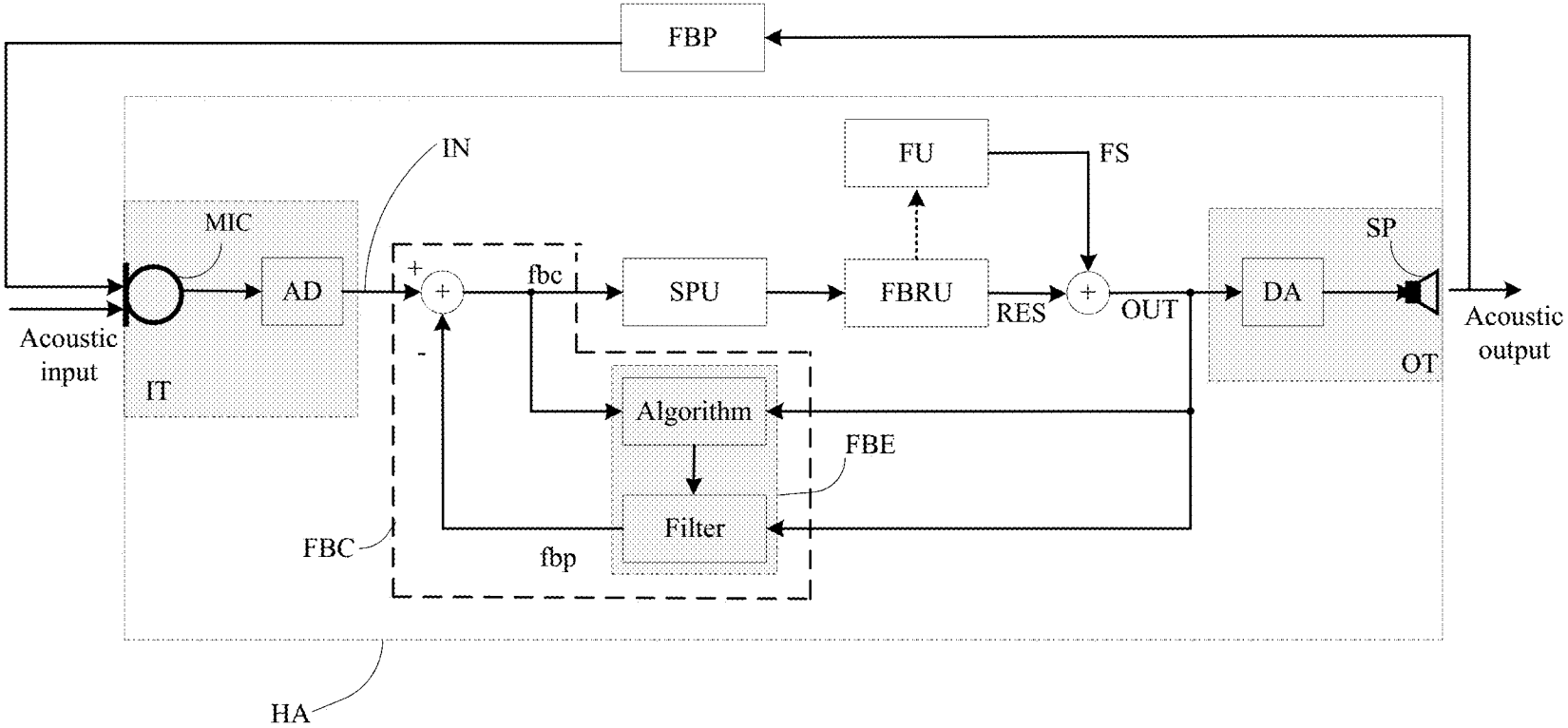
FIG. 5 shows an exemplary hearing aid comprising a feedback cancellation unit and a feedback reduction unit.

FIG. 5 shows an exemplary hearing aid comprising a feedback cancellation unit and a feedback reduction unit.

FIG. 5 shows an exemplary hearing aid (HA) comprising a feedback reduction unit (FBRU) in the forward path of the hearing aid (as also shown in FIG. 2) as well as a feedback cancellation unit comprising a feedback estimation unit (FBE) for estimating the acoustic feedback path (FBP) from the output transducer (OT) to the input transducer (IT). The forward path may further comprise a combination unit ('+') (as also shown in FIG. 1B).

The input transducer (IT) (of the input unit) may further comprise a microphone (MIC) for converting an input sound (Acoustic input) to an analogue electric input signal and an analogue-to-digital (AD) converter to digitize the analogue electric input signal from the microphone (MIC) with a predefined sampling rate, e.g. 20 kHz, and provide a digitized electric input signal (IN) to the forward path.

The output transducer (OT) (of the output unit) may comprise a digital-to-analogue (DA) converter to convert a digital signal (OUT) (e.g. of the combination unit ('+')) to an analogue electric output signal. Further, the output transducer (OT) may comprise a loudspeaker (SP) configured to present the analogue electric output signal to a hearing aid user as an output sound (Acoustic output).

As also shown in FIG. 2, the hearing aid (HA) may comprise a filler signal unit (FU) configured to generate a filler signal (FS) and provide it to the modulated resulting signal (RES) of the feedback reduction unit (FBRU) by the combination unit ('+'). The filler signal (FS) may be provided in one or more second time periods $T_L$, corresponding to one or more reduced forward gains $A_L$.

Figure 6A:
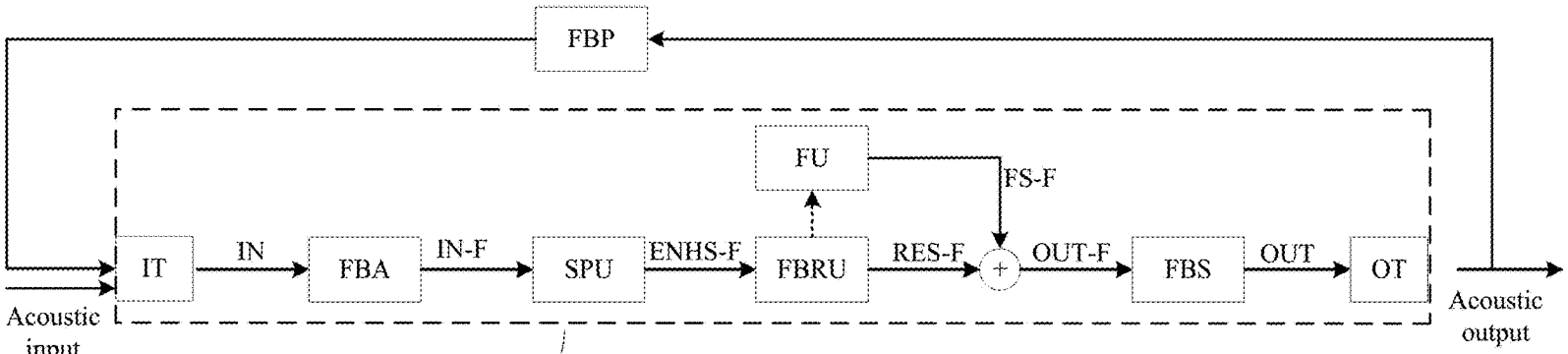
FIG. 6A shows an exemplary hearing aid comprising analysis and synthesis filter banks for analysing different frequency bands separately.

FIG. 6A shows an exemplary hearing aid comprising analysis and synthesis filter banks for analysing different frequency bands separately.

FIG. 6A shows an exemplary hearing aid (HA) comprising a forward path comprising an input transducer (IT) (of an input unit) providing an electric input signal (IN) in the time domain, and an analysis filter bank (FBA) providing the electric input signal IN in a number of frequency bands (e.g. 4, 8, or 64) as band split electric input signal (IN-F).

The forward path may further comprise a signal processing unit (SPU) connected to the analysis filter bank (FBA). The signal processing unit may be configured to apply a requested forward gain to the band split electric input signal (IN-F) and to provide an enhanced band split signal (ENHS-F).

The forward path may further comprise a feedback reduction unit (FBRU) for applying a gain modulation to the enhanced band split signal (ENHS-F) and providing a resulting band split signal (RES-F) with a forward gain exhibiting an increased or unchanged forward gain ($A_H$) in one or more first time periods ($T_H$) and a reduced forward gain ($A_L$) in one or more second time periods ($T_L$) for each of the number of frequency bands. Thereby, a resulting band split signal (RES-F) is provided with a reduced risk of creating feedback (i.e. reducing a risk of creating howl due to acoustic or mechanical feedback from the output to the input transducer).

The forward path may additionally include a filler signal unit (FU) configured to generate a band split filler signal (FS-F), and to provide said filler signal (FS-F) to the resulting band split signal (RES-F) (i.e. to each of the number of frequency bands) of the forward path by a combination unit ('+'). Thereby, an output band split signal (OUT-F) is generated.

The forward path may further comprise a synthesis filter bank (FBS) for generating a resulting time domain signal (OUT) from the resulting band split signal (RES-F). The synthesis filter bank (FBS) may be connected to an output transducer (OT) (e.g. a loudspeaker or a vibrator of an output unit) for converting the resulting time domain signal (OUT) to an acoustic or vibrational stimulus for presentation to a hearing aid user (U).

Figure 6B:
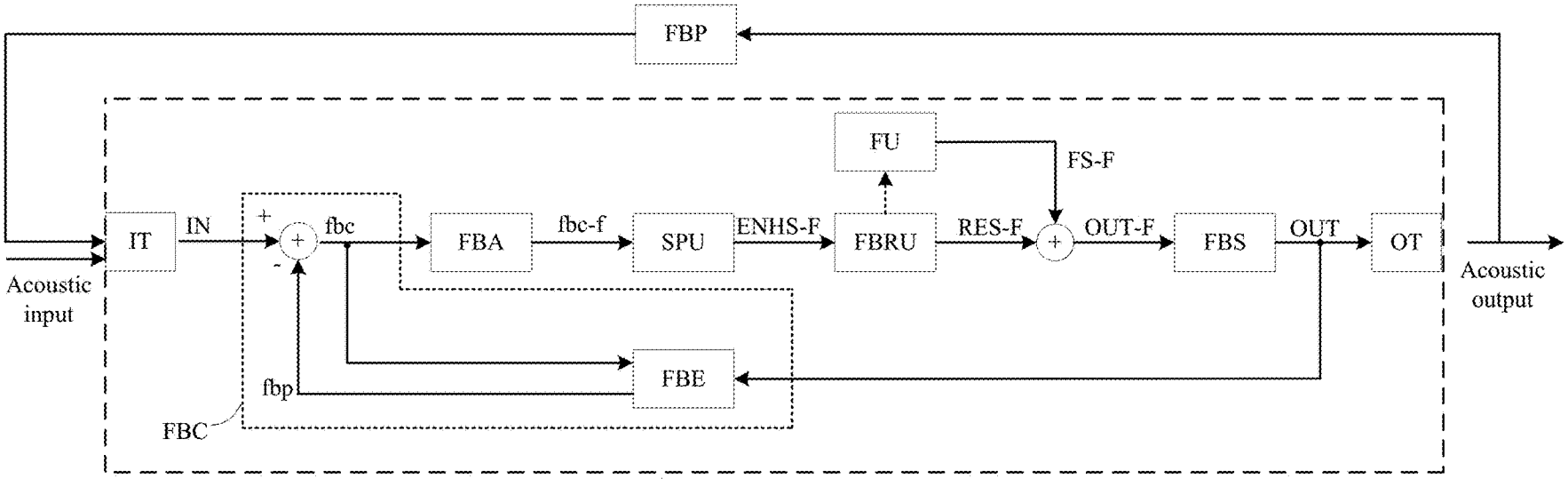
FIG. 6B shows an exemplary hearing aid comprising analysis and synthesis filter banks for analysing different frequency bands separately, and additionally including a feedback cancellation unit.

FIG. 6B shows an exemplary hearing aid comprising analysis and synthesis filter banks for analysing different frequency bands separately, and additionally including a feedback cancellation unit.

In FIG. 6B, an exemplary hearing aid (HA) as shown in FIG. 6A further comprising a conventional feedback cancellation system (FBC) is shown. The feedback cancellation system (FBC) may comprise a feedback estimation unit (FBE) and a combination unit ('+'), where the combination unit ('+') may be located in the forward path of the hearing aid (HA). The forward path may further comprise a feedback reduction unit (FBRU) and the filler signal unit (FU) as described in connection with FIG. 6A.

The feedback estimation unit (FBE) may provide a feedback path estimate signal (fbp), which may be subtracted from the electric input signal (IN) by the combination unit ('+'). The resulting feedback corrected signal (fbc) may be fed to the signal processing unit (SPU) and to the feedback estimation unit (FBE).

The exemplary hearing aid shown in FIG. 6B is similar to the exemplary hearing aid of FIG. 5 (which may operate in the time domain) apart from the fact that, in FIG. 6B, a part of the forward path (comprising the signal processing unit (SPU), the feedback reduction unit (FBRU), and the filler signal unit (FU)) may be operating in the (time-) frequency domain. In FIG. 6B, the feedback cancellation system (including feedback estimation unit (FBE) and combination unit ('+')) may be operated in the time domain. It may alternatively be operated fully or partially in the (time-) frequency domain.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items.

The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

The invention claimed is:

1. A hearing aid configured to be worn by a hearing aid user at or in an ear of the hearing aid user or to be fully or partially implanted in the head at an ear of a hearing aid user, the hearing aid comprising:

an input unit configured to receive an input sound signal from an environment of a hearing aid user and to provide at least one electric input signal representing said input sound signal;

an output unit configured to provide at least one set of stimuli perceivable as sound to the hearing aid user based on a processed version of said at least one electric input signal; and a signal processing unit connected to the said input unit and output unit, wherein the input unit, the signal processing unit and the output unit are forming part of a forward path of the hearing aid;

wherein the signal processing unit is configured to apply a forward gain to the at least one electric input signal or a signal originating therefrom, wherein the hearing aid further comprises a feedback reduction unit configured to reduce a risk of howl due to acoustic, electrical, and/or mechanical feedback of an external feedback path from the output unit to the input unit of said hearing aid, wherein the feedback reduction unit is configured to modulate said forward gain in time to provide that the forward gain exhibits an increased or unchanged forward gain $A_H$ in one or more first time periods $T_H$ and a reduced forward gain $A_L$ in one or more second time periods $T_L$, and wherein the hearing aid further comprises a filler signal unit configured to generate a filler signal, and to provide said filler signal to a resulting signal of the feedback reduction unit in said one or more second time periods $T_L$, corresponding to said reduced forward gain $A_L$, wherein the filler signal unit is configured to provide a filler signal of equal numerical size or smaller size than the difference in forward gain between successively modulated increased or unchanged forward gain $A_H$ and reduced forward gain $A_L$.

2. Hearing aid according to claim 1, wherein the feedback reduction unit determines one or more of said increased or unchanged forward gain $A_H$, reduced forward gain $A_L$, one or more first time periods $T_H$, and one or more second time periods $T_L$ based on a predetermined or adaptively determined criterion.

3. Hearing aid according to claim 2, wherein said forward path and an external feedback path of the hearing aid define a loop path exhibiting a roundtrip loop delay, and wherein said criterion comprises that said one or more first time periods $T_H$ and/or said one or more second time periods $T_L$ time period are based on said roundtrip loop delay of said forward path and external feedback path.

4. A hearing aid according to claim 3, wherein generating a filler signal comprises providing an additional electric input signal representing sound to said resulting signal of the feedback reduction unit.

5. A hearing aid according to claim 2, wherein generating a filler signal comprises providing an additional electric input signal representing sound to said resulting signal of the feedback reduction unit.

6. Hearing aid according to claim 1, wherein generating a filler signal comprises providing an additional electric input signal representing sound to said resulting signal of the feedback reduction unit.

7. Hearing aid according to claim 1, wherein the filler signal unit generates the filler signal based on a noise signal.

8. Hearing aid according to claim 1, wherein the filler signal unit generates the filler signal based on the input sound signal from the environment of a hearing aid user.

9. Hearing aid according to claim 1, wherein the filler signal unit is configured to estimate the size, duration and/or periodicity of the filler signal, based on the resulting signal from the feedback reduction unit.

10. Hearing aid according to claim 1, wherein the filler signal unit is configured to estimate the size, duration and/or periodicity of the filler signal based on advanced signal processing and/or a neural network.

11. Hearing aid according to claim 1, wherein the hearing aid further comprises a feedback cancellation unit.

12. Hearing aid according to claim 1, wherein the hearing aid further comprises an analysis filter bank and a synthesis filter banks, and wherein the filler signal unit is configured to generate a band split filler signal, and to provide said filler signal to the resulting band split signal of the feedback reduction unit.

13. A hearing system comprising left and right hearing aids according to claim 1, wherein the left and right hearing aids are configured to be worn in or at left and right ears, respectively, of said hearing aid user, and/or to be fully or partially implanted in the head at left and right ears, respectively, of the hearing aid user, and being configured to establish a wired or wireless connection between them allowing data to be exchanged between them, optionally via an auxiliary device.

14. A method of processing an electric signal representing sound, the method comprising:

receiving an input sound signal from an environment of a hearing aid user and providing at least one electric input signal representing said input sound signal, by an input unit;

providing at least one set of stimuli perceivable as sound to the hearing aid user based on a processed version of said at least one electric input signal, by an output unit;

applying a forward gain to the at least one electric input signal or a signal originating therefrom, by a signal processing unit connected to the said input unit and output unit, wherein the input unit, the signal processing unit and the output unit forming part of a forward path of the hearing aid;

applying a forward gain to the at least one electric input signal or a signal originating therefrom and providing a processed version of said at least one electric input signal, by the signal processing unit, where the hearing aid further comprises a feedback reduction unit for reducing a risk of howl due to acoustic, electrical, or mechanical feedback of an external feedback path from the output unit to the input unit of said hearing aid;

modulating said forward gain in time, to provide that the forward gain exhibits an increased or unchanged forward gain $A_H$ in one or more first time periods $T_H$ and a reduced forward gain $A_L$ in one or more second time periods $T_L$, by the feedback reduction unit (FBRU); and generating a filler signal, and providing said filler signal to a resulting signal of the feedback reduction unit in said one or more second time periods TL, corresponding to said reduced forward gain AL, by a filler signal unit of the hearing aid, wherein the filler signal, provided by the filler signal unit, is of equal numerical size or smaller size than the difference in forward gain between successively modulated increased or unchanged forward gain $A_H$ and reduced forward gain $A_L$.

15. A non-transitory computer readable medium storing a computer program comprising instructions which, when the program is executed by a computer, cause the computer to carry out the method of claim 14.

16. A data processing system comprising a processor and program code means for causing the processor to perform the method of claim 14.

* * * * *